United States Patent [19]

Iovino et al.

[11] 4,396,154

[45] Aug. 2, 1983

[54] CONTROL VALVE FOR WELDING TORCH AND THE LIKE

[75] Inventors: Pasqualino P. Iovino, Bedford; Bernard R. Danti, Lexington, both of Mass.

[73] Assignee: Patbern, Inc., Bedford, Mass.

[21] Appl. No.: 270,583

[22] Filed: Jun. 4, 1981

[51] Int. Cl.[3] ..... B05B 7/12

[52] U.S. Cl. ..... 239/413; 239/569; 251/344

[58] Field of Search ..... 239/581, 569, 413, 417.5; 137/846; 251/340, 343, 344, 347

[56] References Cited

U.S. PATENT DOCUMENTS

| | | | |
|---|---|---|---|
| 2,509,671 | 5/1950 | Christensen | 251/344 |
| 3,106,378 | 10/1963 | Hellstern | 251/344 X |
| 3,127,149 | 3/1964 | Cruse | 251/344 X |
| 3,425,664 | 2/1969 | Niskin | 251/344 |
| 3,642,249 | 2/1972 | Cruse | 251/344 |
| 3,642,266 | 2/1972 | Diehl | 239/413 X |
| 3,780,943 | 12/1973 | Lilja | 137/846 X |

*Primary Examiner*—Joseph E. Valenza
*Assistant Examiner*—Gene A. Church
*Attorney, Agent, or Firm*—Andrew F. Kehoe

[57] ABSTRACT

An improved valve, and assembly incorporating the valve, which finds particular use in welding and cutting torch control applications. The valve comprises a quick, slide-actuated, on-off control which dispenses with the need to adjust the flow of gases to the torch each time flame start-up is required. The valve also incorporates a variable pilot setting which includes an easily-manipulated cam-adjustment.

9 Claims, 6 Drawing Figures

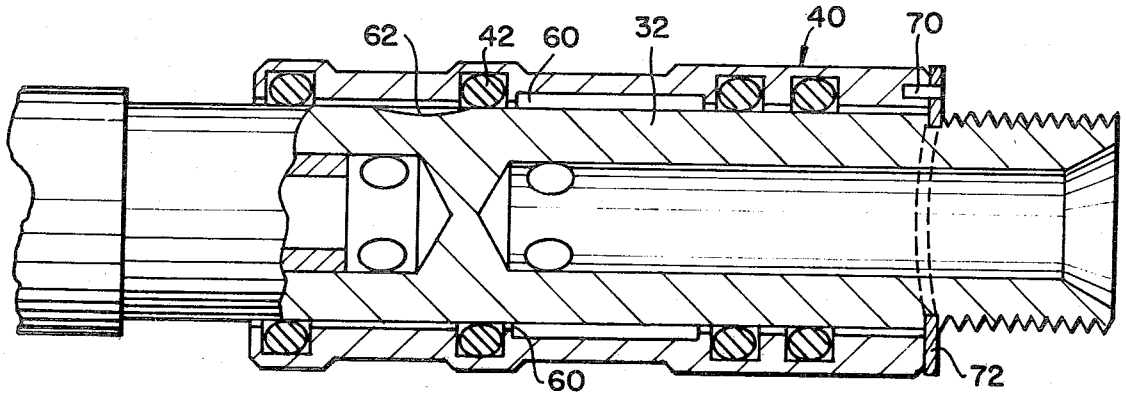
Fig. 3
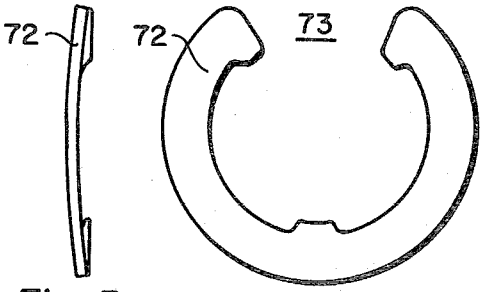
Fig. 6
Fig. 5
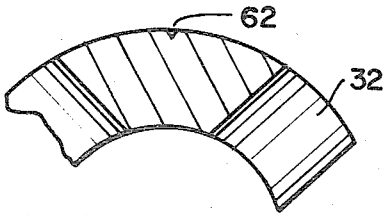
Fig. 4

CONTROL VALVE FOR WELDING TORCH AND THE LIKE

BACKGROUND OF THE INVENTION

This invention relates to novel gas-control valves and, particularly to valves for use with hand-held torches, e.g. acetylene torches, propane torches and the like. These valves are primarily on-off valves or pilot flame control valves, they may be used in emergencies as primary gas valves.

A substantial number of problems are encountered in the use of normal welding and cutting torches. In part, these problems stem from the number of relatively unskilled people using the torches. However, a number of the problems are inherent in the variety of wind conditions or temperatures in which such torches are used. For example, they may be used in a hot work shop or in a cold and windy environment on the same day.

In the past, it has been the common practice for a user of the torch to relight it and adjust the work flame (or have it readjusted for him by a supervisor) at the start of each shift or work operation. The practice requires excessive supervision and, frequently, the use of less than optimum flame setting.

Also, it has been rather time consuming to cut a working flame back to a proper pilot setting during pauses between work operations. In many environments, it is particularly difficult to do because a pilot once turned to low may be blown out by the wind. Thus there is a reluctance to turn back the flame to a pilot position and substantial gas is wasted.

In view of these and other related problems, the inventor believes it desirable to provide convenient new means to valve acetylene torches and the like.

SUMMARY OF THE INVENTION

It is a principal object of the invention to provide an improved slide-actuated valve for use with welding torches and the like.

It is a particular object of the invention to provide a valve which, when used as an ancillary valve in a torch system, will allow shut down and relighting without adjustment of the flame or loss of gases.

A further object of the invention is to provide a multi-position valve with an adjustable pilot feature.

Other objects of the invention are to provide a lightweight, ancillary valve system which provides built-in check valve feature to prevent reverse flow of gasses. The valve will allow an operator to change his torch without shutting off the gas tank valves, or regulator valves, i.e. without leaving a remote or elevated worksite. This feature not only saves time but it avoids loss of the gas in the supply lines.

Another object of the invention is to provide a fast emergency shutdown valve.

Other objects of the invention will be obvious to those skilled in the art on their reading of this disclosure.

These objects are substantially achieved by construction of a manually, slidable, valve comprising an inner valve cylinder or barrel which forms the main inlet and outlet flow paths for the gas. The flow paths do not communicate with one another except through apertures in the barrel wall communicating with each of the inlet and outlet sides of the valve. Gas flows through these apertures but is constrained from escape to the atmosphere by a slidable sleeve member, actually the on-off control member, which is used to move a central seal member into sealing position around the barrel between the sleeve-like control member and each of the inlet aperture and outlet apertures in the barrel wall.

The valve construction preferably includes a very light weight, highly sensitive elastomeric check valve which is mounted within one of the central axial conduits, i.e. within the inlet or outlet flow paths.

This valve is essentially normally-open and, most importantly in accomodating small pilot gas flows, remains dependably open in the absence of back pressure in any attitude. Thus there is no possibility of the valve being closed by gravitational force.

A particularly valuable aspect of the most advantageous embodiment of the invention is the incorporation of a gas-flow control means into the apparatus. This feature is in addition to the primary on-off features of the valve which are achieved by quick lateral movement of the sleeve member of the valve back and forth. The pilot feature is achieved by providing a conduit which is under the central seal member when that seal is slid into a pilot position intermediate between the on and off positions. In the preferred mode of the invention, the pilot position is really a series of positions with the seal member over a differently sized conduit section for different desirable pilot gas flows.

Control of the precise conduit section is facilitated by having a cam-type control means whereby the operator of the valve can rotate the sleeve member with respect to the barrel member and, assuming, e.g. the operator is holding the sleeve snugly against barrel-mounted cam, achieve an easy adjustment of the proper gas flow.

The cam is readily inactivated by any of a number of means including moving the cam follower out of the way so that it does not interfere with the valve proceeding to its normal closed position or, in a C-shaped preferred embodiment, having an aperture in a cam structure mounted around the circumference of the valve so that cam follower can enter the aperture and allow the valve to close.

ILLUSTRATIVE EXAMPLE OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

FIG. 3 shows the valve in closed position.

FIG. 4 shows some detail of a pilot conduit.

FIG. 5 is a side view of a pilot-cam ring.

FIG. 6 is a front view of a pilot-cam ring.

Figure 1:
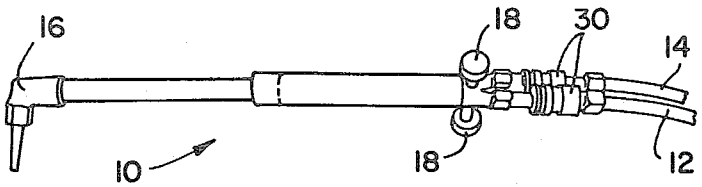
FIG. 1 is a perspective view of a convention welding torch showing the position of valves constructed according to the invention.

Referring to FIG. 1, it is seen that a torch assembly 10 comprises an oxygen supply line 12 and a fuel-gas, e.g. acetylene, supply line 14. Gas is supplied through such lines to a nozzle 16 which is used to direct cutting or welding flame onto the workpiece. The quantities of each gas which are supplied to nozzle 16 can be set by primary gas flow control valves 18.

The subject invention relates to the design, construction and use of ancillary quick-action, on-off valves 30 which are suitably mounted between the supply lines and the torch itself.

Figure 2:
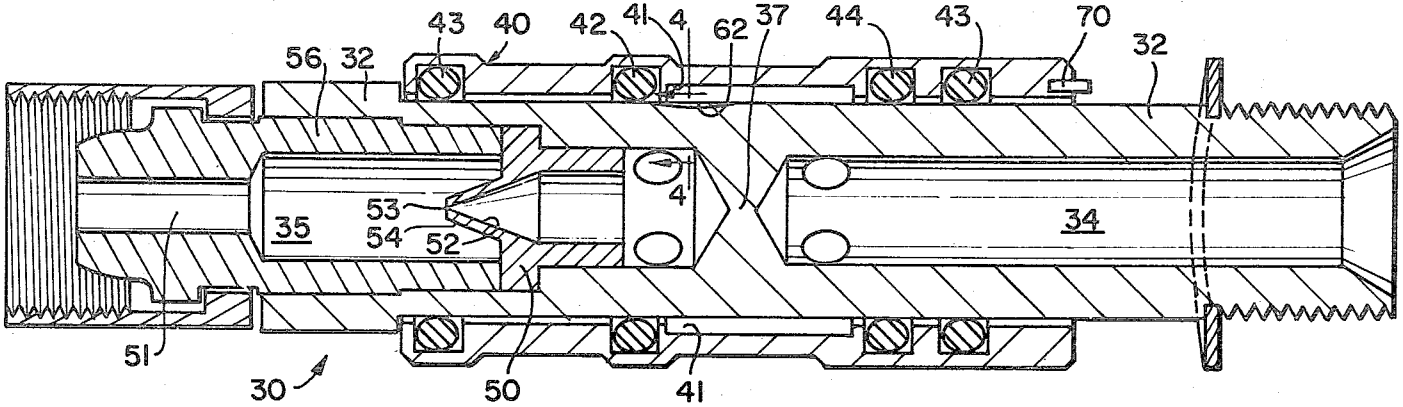
FIG. 2 is a section along the axis of a valve constructed while the valve is in open position.

FIG. 2 is a section taken along the axis of a valve 30 of the type most advantageously used in the fuel-supply line.

Valve 30 comprises a central barrel member 32 which comprises a gas inlet conduit 34 and a gas outlet conduit 35. However, the inlet and outlet conduits do not communicate directly with one another. The gas flow is blocked by a residual wall 37. Instead, when the valve is in its open position as shown in FIG. 2, gas travelling through the valve 30 leaves conduit 34 through a radial aperture (or apertures) 36, moves along the outer surface of barrel member 32 and re-enters barrel member 32 at a second radial aperture (or apertures) 38 and proceeds to leave the open valve through conduit 35 and exit port 51.

As is seen in FIG. 1, the gas is confined by a slidable and adjustable sleeve member 40 and, more particularly by the O-ring seal components 42 and 44 which movement of sleeve 40 causes to be positioned along, and in sealing contact with, barrel member 32. A shallow annular channel 41 is cut within the inner wall of member 40 between a seal 44 and seal 42 to provide a favorable annular conduit for gases to travel from aperture 36 to aperture 38 when the valve is in open position as seen in FIG. 2. Terminal O-ring seals 43 also help to prevent leakage of gas from the valve whether it is in open or shut position.

One valuable feature of the invention is the incorporation of a light-weight check valve 50 into outlet conduit 35 between apertures 38 and the outlet port 51. The check valve is formed of an organic polymeric material and is characterized by a so-called normally open "duckbill" construction. Thus, when gas flows through the open valve it bears against flexible tapered wall surface 52 to keep the valve open by holding open a slit-aperture at 53. When gas would attempt to flow backwards it bears against the outside tapered wall surface 54 and closes the slit opening. Check valve 50 is held snugly within barrel member 32 by check valve retaining insert 56. Insert 56 also serves as an adaptor to facilitate connection of valve 30 into the torch assembly.

FIG. 3 illustrates a similar view to that of FIG. 2 except that it shows sleeve member moved to the right so that the O-ring seal 42, which may be considered the central seal member of the essential O-ring seals, is moved into sealing relationship with the exterior circumference of central barrel 32 at a position between apertures 36 and 38. This effectively closes the valve.

In passing, it can be noted that a bowed C-shaped ring 72 (seen best in FIGS. 5 and 6) is mounted around the exterior of central barrel 32. When pin 70, on sleeve 40 is felt to enter and be rotatably secured in the open area 73 of ring 72, its proper closing position is confirmed to the operator.

The valve as described above provides an excellent means to achieve a quick shut-off of gases, to achieve a way to turn the gases on and off without interfering with work settings set by the valves 18 and for being able to change torches without losing the gases in long lines and without going back to the gas source to effect a shut off.

However, a particularly important aspect of the invention relates to the incorporation of a conveniently-used pilot valve feature which incorporates, as seen in FIG. 4, a small slash or score 62 in the wall 60 of barrel member 32. One practical score configuration has a right angle cross section, reaches a depth of about 0.010 inch when the bottom of the score is on a 1.4-inch radius. When seal 42 is moved over this score mark, rather than to the left or right of it as shown in FIGS. 2 and 3 respectively, the valve is neither in the "on" or "off" position, but in an intermediate or pilot position. The pilot position is characterized by gas being able to flow under central seal means 42 through the conduit formed by score line 62 in wall 60 of the member 30. In the more advantageous embodiment of the invention, one achieved by the aforesaid radial scoring procedure, the score line 62 is of varying depth along its length so that the pilot flow can be changed by very small lateral movements of central seal means 42. This aspect of the valve allows one to adjust the pilot for the conditions of use.

It has been found that a very convenient means for achieving the convenient adjustment of the pilot is to have sleeve 40 rotatable around the circumference of member 30. Then, a pin 70 can act as a cam-follower and manually move to different circumferential positions around and against bowed C-ring 72 which acts as a cam means.

The bowed construction of C-ring 72 assures that the position of seal 42 will move in a predetermined way over the conduit formed by score line 62 as the operator of the valve rotates the sleeve and keeps pin 70 pulled against C-ring 72 which, because of its bow, forms a cam with pin 70 forming the cam follower.

In a torch assembly of the general type shown in FIG. 1, the fuel valve of the invention preferably incorporates the variable pilot feature described above. In many situations, however, the oxygen valve need not incorporate such a pilot feature.

Although the variable cam feature has been described herein as a pilot-control feature, and although the score-conduit has been specifically sized for pilot flame use, it should be understood that the score line of variable cross section can be made larger so that the control feature with which it is favorably utilized can be used as a control means to feed gas directly to a work flame rather than a pilot flame.

It is to be understood that the following claims are intended to cover all of the generic and specific features of the invention herein described and all statements of the scope of the invention which might be said to fall therebetween.

What is claimed is:

1. In a valve of the type comprising central axial conduits within a cylinder which conduit form, respectively, inlet and outlet flowpaths within said valve but which flowpaths do not directly communicate with each other, a first aperture through said cylinder forming means to permit fluid egress from said inlet flowpath, an adjustable slidable sleeve member mounted around said cylinder, at least three seal members mounted within said sleeve for sliding movement with said sleeve along said cylinder, and a central member of said seal members forming means to seal said sleeve member against said cylinder when said central seal is in one position between said first and second apertures forming means to prevent flow of gas through said valve, said central seal member being slidably removable from such first position to permit the flow of gas through said valve, and said two other said seals forming means to seal flow of gas to atmosphere between said cylinder member and said slidable sleeve member; the improvement wherein said central seal member and a groove of varying cross section cut along the axial direction of said cylinder member form an adjustable pilot flowpath between said first and second apertures and means to adjust the stop position of said central seal member with respect to said groove of varying cross section.

2. A valve as defined in claim 1 comprising a normally open light weight elastomeric check valve within one of said central axial conduits.

3. A valve as defined in claim 1 wherein said means to adjust the relative position of said central seal member with respect to said groove of varying cross section, comprises therefore a cam means forming a cam-shaped path at least partially around the circumference of said valve and a cam follower, said cam means and cam follower being rotatable with respect to each other and forming means to moderate the adjustment of said central seal member.

4. A valve as defined in claim 3 wherein one of said cam follower and said cam is mounted on said central sleeve member and the other of said cam follower and said cam is mounted on said central barrel.

5. A valve as defined in claims 3 or 4 wherein said cam in a bowed C-type washer wherein the opening of the "C" forms means to receive said cam flower and allow it to travel sufficiently to remove said central real means from said pilot flow path into valve closing position.

6. A valve as defined in claim 2, 1 or 3 wherein said valve comprises a light-weight, check valve that is normally-open at any attitude in which said valve is place.

7. In a torch assembly comprising a welding torch, at least two primary gas flow control valves each forming means to control the flow of a gas to said torch, and gas-supply conduits forming means to carry a gas to each said torch, the improvement wherein a valve as defined in any of claims 1 or 2 is incorporated between each of said primary gas flow-control valve and the corresponding gas-supply conduit to said flow-control valve.

8. In a torch assembly comprising a welding torch, at least two primary gas flow control valves, one said flow control valve forming means to control the flow of a fuel gas to said torch and the other said flow control valve forming means to control oxygen to said torch, the improvement wherein a valve as defined in claims 1 or 3 is incorporated between said control valve forming means to control said combustion gas and a conduit supplying said combustion gas to said torch assembly.

9. A three position, manually-operable valve comprising an on-position, off-position, and an intermediate pilot-flow position wherein each position is achieved by movement of an exterior sleeve member along the outer periphery of an apertured internal conduit member extending axially beyond said valve member; said sleeve member and apertured conduit member forming, together with seals mounted between them, the flow paths through said valve; and wherein said valve comprises a cam follower and a cam, at least one of which is mounted on said sleeve member and the other of which is mounted around the circumference of said conduit member, said cam follower and cam means forming manual means to provide careful adjustment of the position of said sleeve with respect to a pilot flow path between seals mounted between said conduit member and said seal member.

* * * * *